US005667335A

United States Patent [19]

Khieu et al.

[11] Patent Number: 5,667,335

[45] Date of Patent: Sep. 16, 1997

[54] FIBER REINFORCED RAISED PAVEMENT MARKER AND METHOD OF MAKING

[75] Inventors: Sithya S. Khieu, Eden Prairie, Minn.; David C. May, Hudson, Wis.

[73] Assignee: Minnesota Mining and Manufacturing Commpany, St. Paul, Minn.

[21] Appl. No.: 445,286

[22] Filed: May 19, 1995

[51] Int. Cl.[6] ..... E01F 9/00

[52] U.S. Cl. ..... 404/14; 404/9; 404/12

[58] Field of Search ..... 404/9–16; 428/290, 428/423.1

[56] References Cited

U.S. PATENT DOCUMENTS

| | | | |
|---|---|---|---|
| 3,164,071 | 1/1965 | Rubenstein | 94/1.5 |
| 3,332,327 | 7/1967 | Heenan | 94/1.5 |
| 3,712,706 | 1/1973 | Stamm | 350/103 |
| 3,922,066 | 11/1975 | Schaefer | 350/104 |
| 3,924,929 | 12/1975 | Holmen et al. | 350/103 |
| 3,980,393 | 9/1976 | Heasley et al. | 350/103 |
| 4,070,095 | 1/1978 | Suhr | 350/103 |
| 4,232,979 | 11/1980 | Johnson, Jr. et al. | 404/16 |
| 4,349,598 | 9/1982 | White | 428/161 |
| 4,356,230 | 10/1982 | Emanuel et al. | 428/290 |
| 4,498,733 | 2/1985 | Flanagan | 350/102 |
| 4,717,281 | 1/1988 | Shepherd | 404/16 |
| 4,726,706 | 2/1988 | Attar | 404/14 |
| 4,753,548 | 6/1988 | Forrer | 404/15 |
| 4,875,798 | 10/1989 | May | 404/12 |
| 4,895,428 | 1/1990 | Nelson et al. | 350/103 |
| 5,002,424 | 3/1991 | Hedgewick | 404/14 |
| 5,340,231 | 8/1994 | Steere et al. | 404/14 |
| 5,374,465 | 12/1994 | Fulcomer | 428/122 |
| 5,403,115 | 4/1995 | Flader | 404/9 |
| 5,449,244 | 9/1995 | Sandino | 404/14 |

FOREIGN PATENT DOCUMENTS

| | | | |
|---|---|---|---|
| 0 349 323 A3 | 1/1990 | European Pat. Off. | E01F 9/06 |
| 27 47 324 A1 | 4/1979 | Germany | G02B 5/12 |
| 28 19 006 B1 | 7/1979 | Germany | E01F 9/06 |

*Primary Examiner*—Henry A. Bennett
*Assistant Examiner*—Pamela A. O'Connor
*Attorney, Agent, or Firm*—Gary L. Griswold; Walter N. Kirn; Karl G. Hanson

[57] ABSTRACT

A fiber-reinforced raised pavement marker made of a composite material comprising an isotropic mixture of a polymeric material, reinforcing fibers and a filler material. The results of finite element analysis and composite technology have been combined to produce a pavement marker having high flexural strength and impact resistance without the need for an impact-resistant shell. Durable, high strength composite pavement markers are made by casting a homogenous mixture of chopped glass fibers and a filler material in a polymeric matrix. Placement of a retroreflective lens within the mold followed by pouring and curing the composite material results in a finished product upon release from the mold.

28 Claims, 3 Drawing Sheets

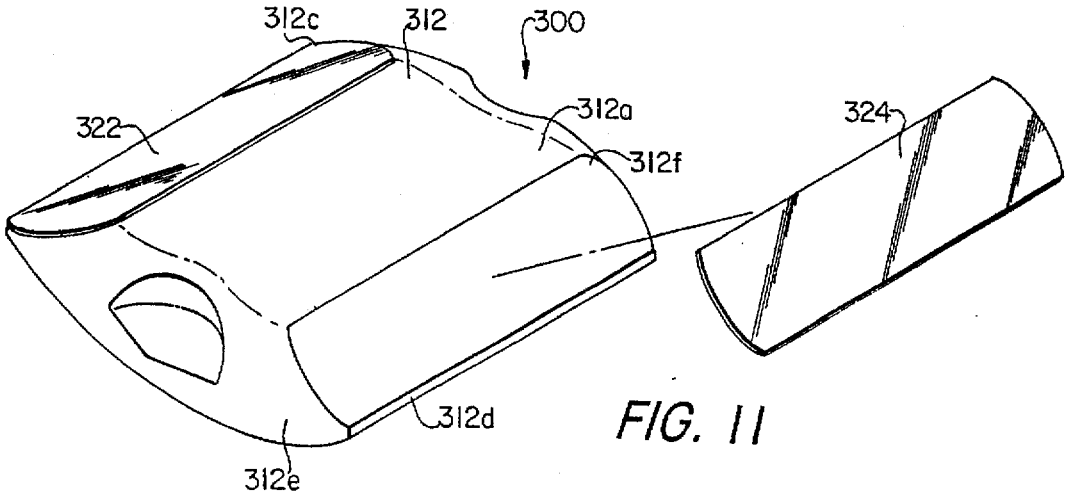
FIG. 11
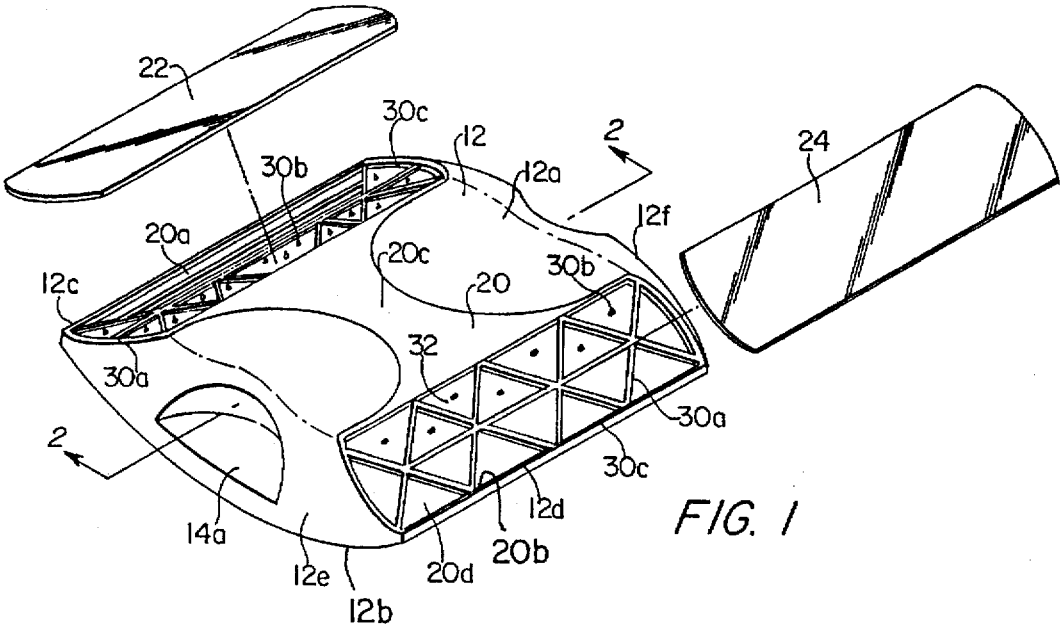
FIG. 1
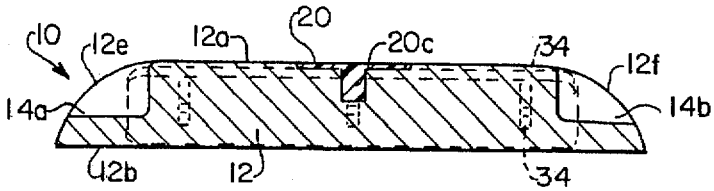
FIG. 2
FIG. 2A
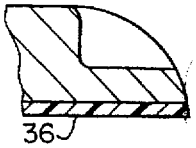

FIBER REINFORCED RAISED PAVEMENT MARKER AND METHOD OF MAKING

BACKGROUND OF THE INVENTION

1. Field of the Invention

The present invention relates to durable raised pavement markers (DRPM's), that are used for traffic markings and delineation. More particularly, the invention relates to DRPM's that are cast using a fiber-reinforced composite capable of providing a high apparent flexural modulus and impact strength to resist vehicle impact.

2. Related Art

Raised markers are used as delineators for traffic lanes to allow drivers of oncoming vehicles to correctly position themselves on the roadway, especially at night or under poor driving conditions. Roadway delineation is accomplished by retroreflective elements that are attached to the face of the raised marker. The retroreflective elements return light from vehicle head lights back to the driver.

Raised pavement markers have been commonly used for many years, and a most successful raised pavement marker is a potted shell type described in U.S. Pat. No. 3,332,327 to Heenan. The shell is typically formed from an acrylic resin and is potted with a filled epoxy resin. These markers tend to break up under repeated impact from vehicles and therefore are likely to require frequent replacement. Under high traffic conditions or when traffic excessively impacts on the markers, failure may occur in only a few months.

Attempts have been made to reinforce the marker shell and potting filler. For example, U.S. Pat. No. 5,002,424 to Hedgewick discloses placing extending ribs in the shell to add additional anchorage to the shell, and filling the shell with an epoxy resin potting material. U.S. Pat. No. 5,340,231 to Steere et al. also discloses a potted shell marker. Steere et al. teach the use of a shell made of a long-fiber reinforced thermoplastic material for high impact-resistance. The marker utilizes a hollow ribbed housing constructed for flexure and strength at elevated temperature. U.S. Pat. No. 5,403,115 to Flader suggests the use of a glass fiber reinforcement in the potting filler, sometimes in combination with a fiberglass mat as further reinforcement for the base. The application notes that adding about one to three percent by weight of chopped fiberglass in the fill results in optimum strength while greater than three percent presents processing problems. The above designs recognize the need for high impact resistance and high flexural modulus but attempt to achieve these properties using a potted shell.

U.S. Pat. No. 3,164,071 to Rubenstein discloses traffic markers having a core made from a rubber-concrete mixture. The core may be laminated with a resin-impregnated fiberglass mat. The core may also be infused with resin or a resin-fiber integument during the lamination process. The marker disclosed by Rubenstein is relatively difficult to make, and voids caused by incomplete infusion may lead to premature failure. Markers of the type taught by Rubenstein have not become commercially successful.

Some pavement markers have been made without an exterior shell. Porcelain clay markers, for example, have achieved commercial success. However, they suffer from shattering on repeated impact, especially on soft roads. In addition, a porcelain marker generally requires significant energy to create, and can present difficulties in permanently attaching a retroreflective element to its exterior.

Since the mid-1980's, the Traffic Control Materials Division of the assignee of the present application (Minnesota Mining and Manufacturing Company, hereafter "3M") has been designing and marketing raised pavement markers. These pavement markers have been made from an injection molded high impact-resistant engineering thermoplastic polycarbonate (PC). U.S. Pat. No. 4,875,798 to May describes markers of this type. The 3M DRPM body design has been generally rectangular in transverse cross-section, with a rounded top and sloping sides. The rounded top allows the impact forces to concentrate on the thickest part of the marker, while providing the added benefit of daytime visibility. The sloping sides provide stress relief from the high compressive impact force and also provide additional surface area for daytime visibility. The use of high impact-resistant engineering thermoplastic PC further increases daytime visibility. But more importantly, the PC material is selected for its high performance impact resistance. The benefit derived from this feature is reduced breakage and cracking in the marker body.

SUMMARY OF THE INVENTION

The present invention provides a fiber-reinforced raised pavement marker comprising a freestanding composite material that is configured in the form of a pavement marker and that comprises an isotropic mixture of a polymeric material, reinforcing fibers and a filler material.

The present invention also provides a raised pavement marker comprising a freestanding composite structure having first and second opposed end faces, first and second opposed side faces, an upper face, a bottom surface, and a cross member. The cross member is mounted on the freestanding composite structure and extends from the first end face to the second end face. The plastic cross member also holds a retroreflective lens.

This invention further provides a fiber-reinforced raised pavement marker comprising a composite material in which the composite material is made from an isotropic mixture comprising 30 to 76% polymeric material, 4 to 6% reinforcing fibers, and 20 to 66% filler material wherein these percentages are weight percent of the total composite material.

The present invention also provides a method of making a fiber-reinforced raised pavement marker in which a polymeric material, glass fibers and a filler material are mixed to form a homogenous mixture and the homogenous mixture is deposited into a mold. The polymeric material is then cured in the mold to form a cast composite material in the shape of a raised pavement marker. The cured marker is then removed from the mold.

In designing the present invention, it was surprisingly discovered that the primary road adhesion failure mechanism in the raised pavement marker lies in the apparent flexural modulus property of the marker body. Apparent flexural modulus is a new parameter that pertains to define the flexural modulus of the marker itself. Apparent flexural modulus is described below in more detail. When a raised pavement marker is impacted by a tire, the marker flexes and pulls on the adhesive that bonds the marker to the road. This pulling action causes peel fronts in the leading and trailing edges of the marker and eventually causes premature marker road adhesion failure. Reducing flexure of the marker reduces this pulling action. Thus, high apparent flexural modulus is a preferred property of the markers of the present invention. This discovery is contradictory to prior art teachings that prescribe marker flexure to conform to the soft asphaltic pavement surface; see for example, U.S. Pat. No. 5,340,231.

The present invention provides numerous advantages. The inventive markers exhibit relatively high apparent flexural modulus and can be manufactured using a relatively simple process at a reasonable cost. Preferred embodiments of the present invention offer the advantage that more than 4 weight percent of reinforcing fibers can be added to the composite for greater impact resistance. A further advantage of the present invention is that the isotropic character of the composite is achieved by casting a homogenous mixture into a mold; this degree of isotropic character is typically not available from processes in which a resin/fiber mixture is infused into a resin/particle core material. This isotropic character enables the marker to withstand impact from any direction. Another advantage of the present invention is that a raised pavement marker having excellent impact resistance can be formed without use of an exterior shell. Exterior shells for prior art pavement markers are typically made by injection molding. The term "freestanding" means the pavement marker does not have an exterior shell either for support or for enhanced impact resistance.

The durable raised pavement markers of the present invention may have a retroreflective lens or lenses mounted to them. In a preferred embodiment, the retroreflective lens is of the cube corner type having an air interface directly behind the cube corner elements. The retroreflective lenses preferably are contained in a thermoplastic housing that is placed in the mold cavity during casting. The housing is secured to the cast composite material during curing to form a unitary marker ready for use.

BRIEF DESCRIPTION OF THE DRAWINGS

The invention is better understood by reading the following Detailed Description of the Preferred Embodiments with reference to the accompanying drawing figures, in which like reference numerals refer to like elements throughout, and in which:

FIG. 1 is a perspective, partially exploded view of a first embodiment of a durable raised pavement marker in accordance with the present invention;

FIG. 2 is a cross-sectional view taken along line 2—2 of FIG. 1;

FIG. 2A is an enlarged cross-sectional view similar to FIG. 2 illustrating an optional modification in which a base layer is attached to the pavement marker;

FIG. 11 is a perspective, partially exploded view of a third embodiment of a durable raised pavement marker in accordance with the present invention.

DETAILED DESCRIPTION OF THE PREFERRED EMBODIMENTS

Figure 3:
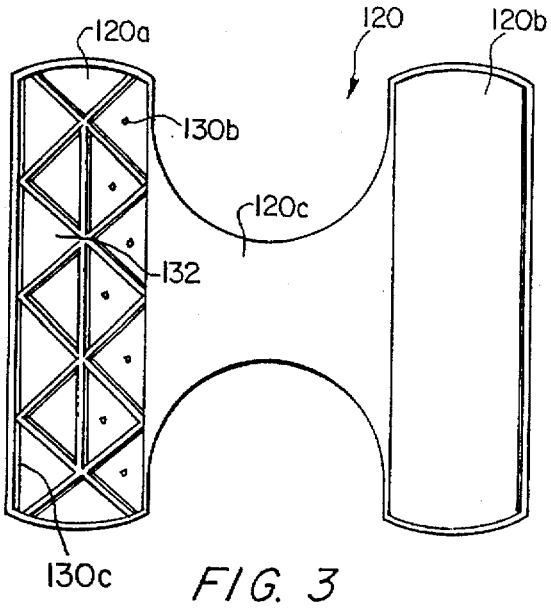
FIG. 3 is a top plan view of a lens mounting system for use with a durable raised pavement marker of the type shown in FIG. 1.

In describing preferred embodiments of the present invention illustrated in the drawings, specific terminology is employed for the sake of clarity. However, the invention is not intended to be limited to the specific terminology so selected, and it is to be understood that each specific element includes all technical equivalents which operate in a similar manner to accomplish a similar purpose.

In FIGS. 1 and 2, there is shown a first embodiment of a durable raised pavement marker 10 that has a body 12 cast of a composite material, the composition of which is described in detail below. Body 12 has a rounded top surface 12*a*, a planar bottom surface 12*b*, inclined first and second end faces 12*c* and 12*d* extending downwardly and outwardly from top surface 12*a* to bottom surface 12*b*, and first and second convexly curved side faces 12*e* and 12*f*. End faces 12*c* and 12*d* are recessed from the surface of body 12. Semi-elliptical recessed finger grips slots 14*a* and 14*b* are formed in side faces 12*e* and 12*f*.

Marker 10 has a generally low profile and curved edges to minimize vehicle impact. Thus, and by way of illustration only, an exemplary marker 10 has a height of about 0.625 inch (1.6 cm), a side-to-side width at its widest point of about 4.0 inches (10.2 cm), and an end-to-end length (across end faces 12*b* and 12*c*) of about 3.5 inches (8.9 cm). End faces 12*c* and 12*d* are inclined at an angle of about 25° to about 35° and preferably about 30° to bottom surface 12 and at their junctions with bottom surface 12 are curved on a radius of about 0.03 inch (0.08 cm). Top surface 12*a* is curved on a radius of about 6.5 inches (16.4 cm). Side faces 12*e* and 12*f* are curved from top to bottom on a radius of about 0.75 inch (1.9 cm) and from side to side on a radius of about 3.0 inches (7.6 cm), and they terminate about 0.58 inch (1.46 cm) above bottom surface 12*b*. The bottom surfaces of finger grip slots 14*a* and 14*b* are inclined at an angle of about 13° to bottom surface 12*b* and terminate about 0.14 inch (0.36 cm) above bottom surface 12*b* ; the upper edges are curved at their junction with side faces 12*e* and 12*f* on a radius of 0.06 inch (0.15 cm).

As shown in FIG. 2A, a base layer 36 is, in some embodiments, attached to the bottom of the fiber-reinforced composite marker. The base material is preferably formed from a polymer that is reinforced with a woven fiber glass mat. The fiber glass mat can provide a rough surface for enhanced bonding to the road surface.

As shown in FIGS. 1 and 2, a lens mounting structure 20 is used to mount first and second retroreflective lenses 22 and 24 to first and second end faces 12*c* and 12*d* of body 12. In the embodiment shown in FIGS. 1 and 2, lens mounting structure 20 has a saddle-like configuration comprising a first lens mount 20*a* mounted in first end face 12*c*, a second lens mount 20*b* mounted in second end face 12*d*, and a cross-piece 20*c* swaddling top surface 12*a* connecting first and second lens mounts 20*a* and 20*b*. First and second lens mounts 20*a* and 20*b* are dimensioned to cover substantially all of first and second end faces 12*c* and 12*d*, respectively.

Lens mounting structure 20 preferably is a plastic that has been injection molded to have energy directors 30*a*, 30*b*, and 30*c* projecting from its upper surface 20*a*. Energy directors are components that support the retroreflective lens and help dissipate impact energy. The lower surface of lens mounting structure 20 has a plurality of barbed fingers 34 that are retained within cast body 12. First and second lenses 22 and 24 can be ultrasonically bonded to energy directors 30*a*, 30*b*, and 30*c*. The use of energy directors for the ultrasonic welding of retroreflective lenses is described in U.S. Pat. No. 4,875,798, incorporated herein by reference in its entirety.

Figure 10A:
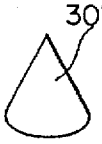
FIG. 10A is a first embodiment of a single energy director.
Figure 10B:
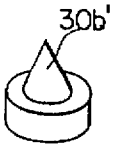
FIG. 10B is a second embodiment of a single energy director.
Figure 10C:
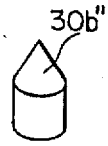
FIG. 10C is a third embodiment of a single energy director.

Energy directors 30*a* are in the form of septa that define cells 32 therebetween, and energy directors 30*b*, which are in the form of pillars located within the upper row of cells 32. Energy directors 30*b* can be conical, as shown in FIG. 10A, they can be in the form of a cone superimposed on a cylinder, as indicated by reference numerals 30*b'* and 30*b"* shown in FIGS. 10B and 10C, or any other shape that provides point contact with lenses 22 and 24. Some energy directors 30*a* are arranged in triangular patterns. Although energy directors 30*a* can also be arranged in rectangular, trapezoidal, and other geometric patterns, the triangular pattern shown in FIG. 1 typically is the sturdiest of these geometric patterns and generally uses the least amount of material.

Energy directors 30*b* provide extra support along the top row of cells 32. The extra support is desirable because a vehicle tends to impact marker 10 about one-third the distance from the top area, and with only energy directors 30*a*, the lenses can break under repeated impacts. Adding the singular energy directors 30*b* provides additional support for lenses 22 and 24 to minimize breakage and also to minimize the loss of retroreflectivity. Along weld lines, cube corners of the retroreflective lens structure are destroyed making that part of the lens not retroreflective. The singular energy directors 30*b* can minimize the number of weld lines while providing enough support to withstand vehicle impacts.

Energy director 30*c* is provided inside the perimeter of end faces 12*b* and 12*c*. Energy director 30*c* has a height slightly greater than that of energy directors 30*a* and 30*b*, in order to hermetically seal the perimeter of the lenses 22 and 24 and prevent moisture, dirt, and other contaminants from contacting the cube corner elements. It has been found useful to have this height about equal to the height of the cube corner reflectors. The energy directors provide hermetically sealed cells that can prevent contamination of adjacent cells when one cell is broken.

Figure 4:
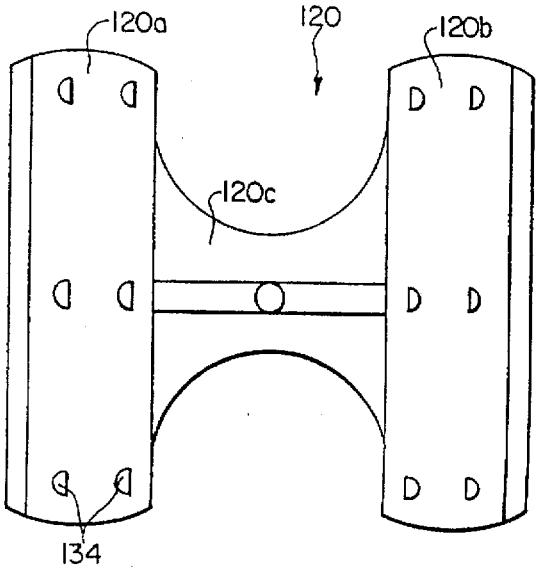
FIG. 4 is a bottom plan view of the lens mounting system of FIG. 3.
Figure 5:
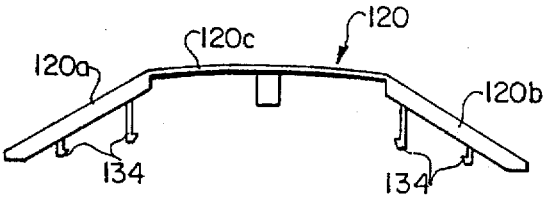
FIG. 5 is a side elevational view of the lens mounting system of FIG. 3.

Raised pavement marker 10 having the lens mounting structure 20 as shown in FIGS. 1 and 2 is intended primarily for use on undivided roadways, where both end faces 12*c* and 12*d* are visible to drivers of oncoming vehicles. For use on divided roadways, where only one end face is visible to drivers of oncoming vehicles, an alternative lens mounting structure 120, shown in FIGS. 3–5, can be used. Lens mounting structure 120 has a saddle-like configuration similar to that of lens mounting structure 20, comprising a lens mount 120*a* mounted in first end face 112*c*, a blank face 120*b* mounted in second end face 112*d*, and a cross-piece 120*c* straddling top surface 112*a* connecting lens mount 120*a* and blank face 120*b*. Lens mount 120*a* and blank face 120*b* preferably are dimensioned to cover substantially all of first and second end faces 112*c* and 112*d*, respectively.

Like lens mounting structure 20, lens mounting structure 120 preferably is a plastic that has been injection molded to have energy directors 130*a*, 130*b*, and 130*c* projecting from the upper surface of lens mount 120*a*. Energy directors 130*a* are septa that form a plurality of cells 132 in lens mount 120*a*, while energy directors 130*b* are distributed in the upper row of cells 132 and energy director 130*c* extends inside the perimeter of lens mount 120*a*. The lower surface of lens mounting structure 120 has a plurality of barbed fingers 134 like those of lens mounting structure 20.

Figure 6:
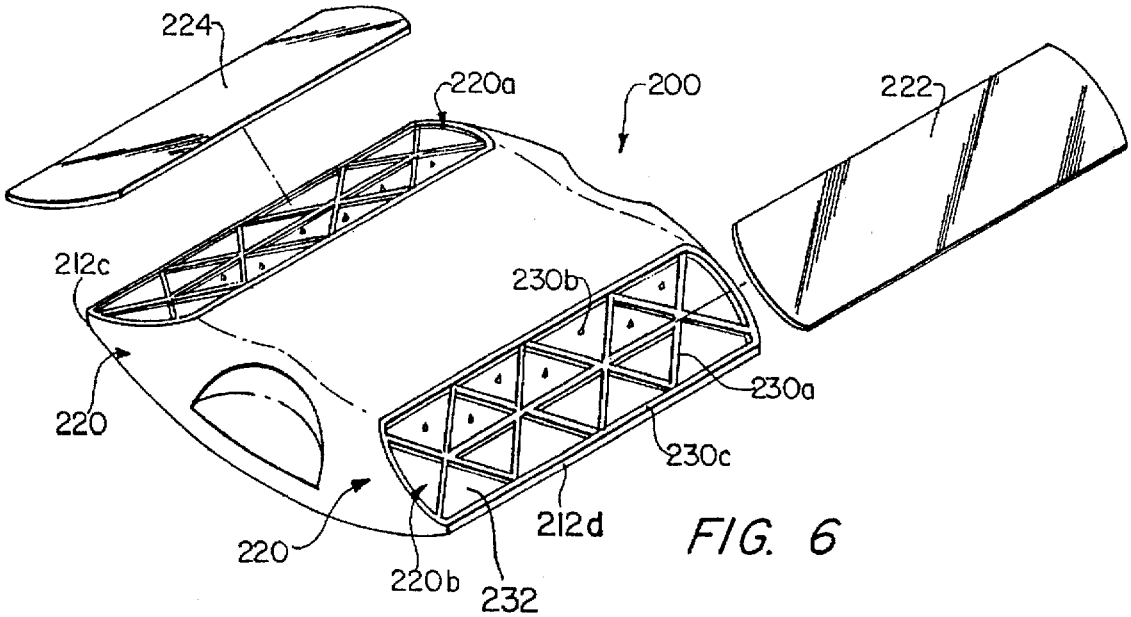
FIG. 6 is a perspective, partially exploded view of a second embodiment of a durable raised pavement marker in accordance with the present invention.
Figure 7:
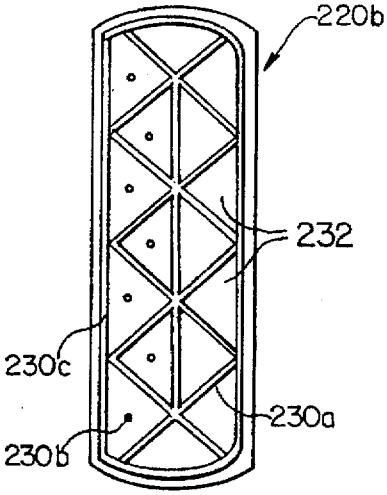
FIG. 7 is a top plan view of one side of the lens mounting system of the durable raised pavement marker of FIG. 6.

FIG. 6 illustrates a marker 200 with another alternative lens mounting structure 220. Instead of having a saddle-like configuration like lens mounting structure 20, lens mounting structure 220, as shown in FIGS. 6–9, has independent lens mounts 220*a* and 220*b* mounted in first and second end faces 212*c* and 212*d*, respectively. Lens mounts 220*a* and 220*b* are dimensioned to cover substantially all of first and second end faces 212*c* and 212*d*, respectively.

Figure 8:
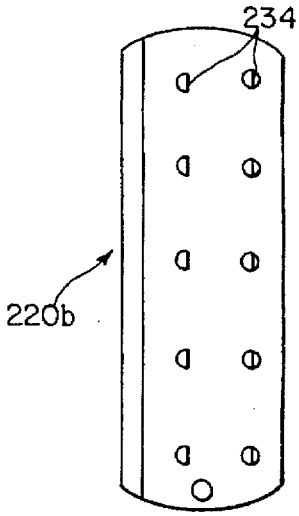
FIG. 8 is a bottom plan view of the lens mounting system of FIG. 6.
Figure 9:
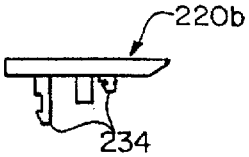
FIG. 9 is a side elevational view of the lens mounting system of FIG. 6.

Lens mounting structure 220 also has energy directors 230*a*, 230*b*, and 230*c* projecting from the upper surface of lens mounts 220*a* and 220*b*. Energy directors 230*a* are again in the form of septa forming a plurality of cells 232, and energy directors 230*b* are distributed in the upper row of cells 232. Energy directors 230*c* extend inside the perimeters of lens mounts 220*a* and 220*b*. Lenses 222 and 224 can then be ultrasonically welded to energy directors 230*a*, 230*b*, and 230*c* as described above. The lower surface of each lens mount has a plurality of barbed fingers 234 as shown in FIGS. 8 and 9 with respect to lens mount 220*b*.

Various types of retroreflective lenses and methods of attachment are envisioned as being suitable for use in the marker. Detailed descriptions of suitable retroreflective lenses are provided in U.S. Pat. Nos. 3,712,706, 4,875,798, and 4,895,428 to Nelson et al.; U.S. Pat. No. 3,924,929 to Holmen, U.S. Pat. No. 4,349,598 to White, and U.S. Pat. No. 4,726,706 to Attar, all of which are incorporated herein by reference in their entireties.

In a first embodiment, lenses 22 and 24 (or 222 and 224) are made by placing a sheet of clear polycarbonate on a cube corner tooling, applying heat and pressure, and then allowing the sheet to cool, thus forming microcube corner sheeting. This sheeting is die cut into lens pieces that can then be mounted in lens mounting structure 20 in one of two ways. In the first way, the lens piece is ultrasonically welded into lens mounts 20*a* and 20*b* of lens mounting structure 20. Energy directors 30*a* are molded in generally triangular patterns selected to optimize the structural integrity of lenses 22 and 24 against vehicle impact and the retroreflectivity of lenses 22 and 24. In the second way, a vapor coating of a reflective material—which preferably is aluminum, but can also be silver, chrome, gold, etc.—is deposited on lenses 22 and 24. Lenses 22 and 24 are then adhered to blank lens mounts identical to lens mount 120*b*, using, for example, a pressure sensitive adhesive. When the lenses 22 and 24 are provided with a reflective vapor coat, the recessed end faces 12*c* and 12*d* of the housing do not have to be provided with energy directors because an air interface behind the retroreflective lens is not required.

Although the lens mounted in accordance with the first mounting method will lose some of its brightness, it loses far less than a lens mounted in accordance with the second mounting method. In addition, it has permanently moisture-sealed pocket regions which are defined by the energy director pattern (i.e., septa 3).

In a second embodiment, lenses 22 and 24 can be made using an injection molding process. The microcube corner tool is cut in the shape of the lens piece, with the energy director pattern formed on each individual lens. Therefore, when each lens is molded, it contains the proper shape without the necessity of die cutting, and also includes built-in energy directors. The lens system in accordance with the second embodiment eliminates the need for an energy director pattern formed in the recessed end faces 12*c* and 12*d* of the housing. The recesses in the housing thus are provided with planar faces.

Referring to FIG. 11, there is shown an alternative embodiment 300 of a cast DRPM in accordance with the present invention. Marker 300 has a body 312 that can be cast of the same composite material as marker 10. Body 312 has a rounded top surface 312*a*, a planar bottom surface 312*b*, inclined first and second end faces 312*c* and 312*d* extending downwardly and outwardly from top surface 312*a* to bottom surface 312*b*, and first and second curved side faces 312*e* and 312*f*. The dimensions of body 312 can be similar to those of body 12.

Unlike the aforementioned embodiments, marker 300 lacks a separate lens mounting structure 20, 120, or 220. Instead, body 312 is cast directly over lenses 322 and 324, with lenses 322 and 324 positioned upside down in the mold cavity at the location of first and second end faces 312*c* and 312*d*. Lenses 322 and 324 also can be of the type described in the previously mentioned patents. Alternatively, body 312 can be cast with recessed end faces 312*c* and 312*d*, and retroreflective lenses 322 and 324 can be affixed in place in the recesses by an adhesive suitable for outdoor use, such as an epoxy resin.

The bodies of markers 10, 200, and 300 are cast using a fiber-reinforced composite material. In a preferred embodiment, the fiber-reinforced composite includes talc and silica sand as particulate reinforcements, and the composite matrix is a two-part epoxy system.

Composite materials can be classified by the type of reinforcements. Particulate-reinforced composite materials generally are either of the large-particle or dispersion-strengthened types. Both types of particulate-reinforced composite materials work to increase the flexural modulus of the material, either by transferring the load (for large-particle reinforcements) or by hindering the motion of the dislocation upon applied force (for dispersion-strengthened reinforcements, on a molecular or atomic level where the small dispersed particles act).

Fiber reinforced composite materials fall into one of three categories: (1) long fiber, (2) structural, or (3) short fiber. Long fiber composite materials tend to be highly anisotropic; that is, the strength of this type of composite material depends largely on the orientation of the fiber. Structural fiber-reinforced materials are of sandwich or laminate types, which are often used in the aerospace industry. Typically structural materials are resin-impregnated matted or woven fiberglass sheets.

The short fiber composite materials utilize chopped fiber of some length which generally are specified by the load transferring requirement and the processing capability. Short fiber composite materials can either be aligned or random. Oriented short fiber composite materials work in a similar manner to continuous or long fiber composite materials. Random short fiber composite materials are isotropic, which means that these materials can bear an applied load independent of the load vectors; however, the effective increase in the composite strengthening and stiffening depends on the length of the fibers. The fibers preferably are greater than the critical fiber length ($l_c$), which is a function of the fiber ultimate strength ($\sigma_f$) and its diameter (d) and is inversely proportional to the ultimate sheer strength ($\tau$) of the matrix ($l_c=(\sigma_f*d/\tau)$). The modulus of the composite material varies linearly with the modulus of the matrix plus some fraction of the fiber modulus and their respective volume fractions. For more information on fiber-reinforced composite materials see "Materials Science and Engineering," by William D. Callister, Jr., John Wiley (1991).

Preferably, reinforcing fibers of the present invention are at least as long as the critical length (about 1 mm) and more preferably have a length/diameter ratio greater than 150. Smaller glass fibers tend to act as particles and may not provide satisfactory impact resistance. It is also preferred that the glass fibers are not too long (i.e., preferably are shorter than about 0.5 inch (1.27 cm)) to avoid problems associated with increased viscosity and anisotropy. The fibers preferably are made of carbon, ceramic or silica-based glass. Fibers longer than about one half inch (1.27 cm) increase impact resistance but are difficult to process because the marker geometry contains small grooves and curvatures, the length of fiber is preferably less than about 1.27 cm for aesthetic reasons. The diameter of fibers is preferably between about 3 to 20 microns.

A particular example of fibers that may be used in this invention include silane-pretreated glass fibers that are about one eighth inch (0.32 cm) in length and about 14 microns in diameter (E glass purchased from Dow Corning). As purchased, the glass fibers tend to clump in bundles, and these bundles are not completely dispersed by the low shear used in the examples described herein. Scanning electron microscope analysis of cross sections of the composite materials using these fibers showed that the glass fibers were isotropically mixed in the composite with about one quarter of the fibers dispersed as single fibers and about three quarters of the fibers in bundles of 20–40 fibers. It is preferred that the glass fibers are added in an amount of at least 4% by weight of the total composite to achieve high impact resistance. It is also preferred, however, that the glass fibers do not exceed 6% by weight of the total composite for ease of processing. In a preferred embodiment, the mixture of glass fibers and sand does not exceed 60% by weight of the total composite because such mixtures can be difficult to process.

The matrix of the composite material of the present invention can be prepared from a wide variety of polymeric materials. The polymeric material may be a thermosetting resin or a chemically setting resin such as an epoxy resin in combination with a curing agent. Examples of suitable polymers include epoxy resins, thermosetting acrylics, polyesters and polyurethanes. An especially preferred matrix for the composite cast marker of the present invention is formed from an epoxy resin in combination with an amine curing resin. The polymeric material preferably is present in the composite material in a range between about 30% to 76% by weight of the total composite and more preferably about 30 to about 40 weight percent.

Filler materials of the present invention preferably comprise hard particulate substances. Typically, the filler materials are inorganic oxides. Preferred filler materials include sand, talc, calcium carbonate and glass dust. Larger particles, such as silica sand can increase the flexural modulus of the composite by transferring the impact forces from the matrix. In addition, the sand displaces the volume of the resin, which may save cost by reducing the amount of resin used. The larger particles are preferably about 300 microns to about 850 microns in diameter (about 20 to 50 mesh) and more preferably about 300 to 400 microns and most preferably about 375 microns (about 40 mesh). The larger particles are preferably used in amounts from about 20 to about 60 weight percent and more preferably about 30 to about 50 weight of the composite material.

Relatively finer particles such as talc, calcium carbonate and glass dust increase the hardness of the composite and strengthen the material by stopping crack propagation. The fine particles preferably have an average particle size (number average) of about 0.01 micron to about 5 microns, more preferably of about 0.01 micron to about 1 micron and still more preferably of about 0.01 micron to about 0.1 micron. Fine particles preferably are used at about 10 to 50 weight percent, and more preferably about 20 to 30 weight percent. In addition to filler material, the composite may also contain coloring pigments such as white, blue, green, yellow, or red. UV stabilizers may also be added. For aesthetic purposes, such as to color the marker, it may be useful to apply a thin coating of polymeric material either to the mold prior to casting the marker or to the marker after removal from the mold.

Raised pavement markers of the present invention can be made by a process in which an isotropic mixture of polymeric material, reinforcing fibers and filler material are cast in the shape of a raised pavement marker. In a preferred embodiment, fine filler particles are mixed with the resin at an elevated temperature. This mixing can be accomplished, for example, by mixing with a dispersion blade at about 1400 rpm for 20 to 30 minutes. A coloring pigment, preferably $TiO_2$, can be mixed in at the same time as the fine particles. The smoothness of the dispersion can be measured with a "scratch" gauge that preferably reads between 8 and 9.

After the fine particles have been dispersed in the resin as described above, chopped glass fibers and sand may be added. The mixture is heated to reduce viscosity. Preferably the sand and glass fibers are added while the resin is mixed. It is preferred, in this step, that mixing is conducted at a relatively low shear for a short time—for example, mixed with a pump blade at about 560 rpm for about 5 minutes. The mixing should be sufficient to achieve homogeneity, but preferably is not over-mixed causing the mixture to become viscous. It is believed that the increased viscosity caused by over-mixing is due to separation of the fiber bundles. In a particularly preferred process, the sand/glass is premixed and poured steadily into the mixture as it is mixed, it is also helpful if the sand/glass mixture is preheated to about the same temperature as the mixture.

In a preferred embodiment, the reinforcing particles and fibers are mixed into an epoxy resin and curing agent, respectively, in separate containers. The epoxy resin mixture and the curing agent mixture are then mixed to form a homogenous mixture before depositing the mixed material into a mold. In a preferred embodiment, the epoxy mixture and the curing agent mixture are combined in a 1:1 volume ratio. Preferably, the epoxy resin mixture and curing agent mixture are pumped from their respective containers at elevated temperature by a rod meter pump operating at increased pressure (for example, 80 psi). The epoxy resin mixture and curing agent mixture may be mixed in a static mixer having helical mixing elements. Other types of mixing systems such as a dynamic mixer can also be used.

After the polymeric material, reinforcing fibers and filler material have been combined in an isotropic mixture, the isotropic mixture is deposited into a mold. It is important to avoid introducing bubbles into the composite material during the mixing or pouring steps. Bubbles may lead to voids and consequently may reduce the resulting marker's flexural modulus and impact strength. The interior of the mold is shaped like the exterior of a pavement marker.

The molding step may be carried out according to processes known in the art. In one embodiment, the composite material is encapsulated in a static mold. In another embodiment, one side of the mold is left open to the air. In another embodiment, the mold is vibrated to ensure complete distribution of the composite material throughout the mold and to assist in eliminating voids. In yet another embodiment, vacuum is applied to the mold to assist in eliminating voids.

In a preferred embodiment, a retroreflective lens is placed in the mold before adding the isotropic mixture.

The mixture is then cured to form a high apparent flexural modulus and high impact strength composite marker. In this fashion, the resulting cast marker can be removed from the mold with the attached retroreflective lens and is ready for placement on a roadway. In a less preferred embodiment, a retroreflective lens is bonded to the pavement marker after removal from the mold.

In preferred embodiments, an epoxy resin/amine curing agent composite mixture is set in a mold by curing at about 150° F. (66° C.) for about 10 minutes.

The marker base can be modified to improve adhesion to the road. These modifications may be accomplished by conventional techniques. For example, the mold cover can have indentations generating a rough pattern on for the base. Alternatively, sand, chopped glass fibers, or a woven glass mat could be applied the base at elevated temperatures.

Testing of the cast composite pavement markers of the present invention has been conducted. Measurements of apparent flexural modulus was conducted according to a modified version of ASTM Method D790 Section 9.1. This method was chosen over the method of ASTM D4280 because ASTM D4280 requires that markers have a length and width greater or equal to 4.0 inches (10.16 cm) which many pavement markers do not have. Moreover, through testing it was discovered that the standard ASTM D4280 method shows a poor correlation between flexural strength and marker road adhesion. ASTM D790 specifies the dimensions of the sample, and the equation necessary for calculating the flexural modulus. The span in the ASTM D790 and section 6.2.1 is specified as being 16 times the sample thickness. The geometry of the raised pavement markers differ from this dimensional ratio. Therefore, in order to obtain a uniform and comparable test result among the different raised markers tested, the span of the marker was fixed at 1.85 inches (4.70 cm) to accommodate all the various types of markers. The introduction of this fixed span also insured that the effect of the shear in the modulus calculation was uniform for all markers. This normalized modulus is referred to as apparent flexural modulus, or apparent modulus. The apparent modulus is a number expressed in pounds per square inch (psi) or Pascal (Pa) which represents the flexural modulus of the marker and which is specific to that marker. The apparent modulus was determined by the following equation specified in the ASTM test method D790:

$E=span^3*slope/4*length*thick^3$ where Span=1.85 inch (4.70 cm)

Slope=change in load/change in deflection at bottom relative loading point

Length=length of marker

Thick=Thickness of marker

E=apparent modulus

Apparent modulus values were acquired from tests conducted on material testing machine MTS Model 810 with a pair of MTS extensometers Model 632.17B-20. The samples were placed on two supports as described in ASTM D790 for a three point bending mode. The dimensions of the sample thickness and length are the marker thickness and the marker length, and the span was fixed at 1.85 inches (4.7 cm) which introduces the same shear effects for all marker samples in the calculation of the modulus. The pair of extensometers was used to measure the deflection of the marker at its bottom. The extensometer needles measure the flex under the marker; the needles are positioned along the bottom, on the center line bisecting the fingergrips of the marker. The flexing that causes the damage to the adhesive/road, adhesive/adhesive, and adhesive/marker base interfaces occurs at the base of the markers; that is why the high precision extensometers were used to measure the deflection at the base. The MTS was set to load on the top center of the marker up to a maximum force of 1000 lbs. The deformation rate was set at 0.1 inch/minute (0.25 cm/minute) which was calculated from the equation given in section 9.1.1 of ASTM D790. The flexural modulus of the composite material itself (in sheet form) can be measured according to ASTM D790.

Testing of two markers prepared according to Example 1 showed an apparent flexural modulus of averaging about 550,000 psi ($3.79\times10^9$ Pa).

It is preferred that the cast markers of the present invention have an apparent flexural modulus of at least 80,000 psi ($5.5\times10^9$ Pa), more preferably of 400,000 psi ($2.75\times10^9$ Pa) 800,000 psi ($5.52\times10^9$ Pa). Flexural modulus values (as measured by ASTM D790) of about 500,000 psi ($3.45\times10^9$ Pa/and 2.4 million psi ($1.65\times10^{10}$ Pa) are also preferred.

Impact testing was conducted on a marker made according to the method of Example 1. Impact testing was carried out according to ASTM D3029, Sections 7–15, except that a 0.50 inch (1.3 cm) tub diameter was used instead of 0.625 inch (1.625 cm) tub diameter. The marker was placed on a flat metal plate. A one pound (0.45 kg) dart was dropped onto the marker 10 times from a height of 118 cm (45.5 in.). The first drop only caused a small dent. The second drop caused a slightly larger dent. The third drop caused a hairline crack at the finger grip. After seven drops, there were cracks at both sides of the finger grips. After the tenth drop, the marker was cracked into four pieces held together by the glass fibers.

It is highly desirable that the pavement markers of the present invention have good impact resistance. Thus it is preferred that the pavement marker can withstand one drop of a one pound (0.45 kg) dart from 45.5 inch (118 cm) without cracking. It is also preferred that the marker withstand 3 such drops without breaking into pieces.

EXAMPLES

The following non-limiting examples further illustrate the invention. These examples are only a portion of multiple examples that have been prepared. All parts, percentages, ratios, etc., in the examples are by weight. The following abbreviations and trade names are used throughout:

| | |
|---|---|
| Epon826 | a bisphenol A/epichlorohydrin based epoxy resin available from Shell Chemical, Houston, TX |
| Epon828 | a bisphenol A/epichlorohydrin based epoxy resin available from Shell Chemical, Houston, TX |
| Epon 828/$TiO_2$ | a premix of 40% Epon826 and 60% of $TiO_2$ particles particle size <0.1 micron, Stan-Tone 10 EPX03 from Harwick Chemical Corporation, Akron, OH |
| Epicure 3270 and 3271 | a solution of N-aminoethylpiperazine, diethylenetramine and nonyl phenol from Shell Chemical, Houston, TX |

-continued

| | |
|---|---|
| DMP 30 | 2,4,6-Tri (dimethylaminomethyl) phenol (89–98%), (dimethylamino)methylphenyl (2–11%), phenol (<0.2%), formaldahyde (<0.08%) available from Rohm and Haas, Philadelphia, PA |
| $TiO_2$ | Ti-Pure $TiO_2$ R960, particle size <1 micron, available from DuPont, Wilmington, DE |
| Sand | mesh grade 40, particle size about 375 micron, available from Cemstone Product Co., St. Paul, MN |
| $CaCO_3$ | ultrafine precipitate, particle size <1 micron |
| Talc | Mistron Superfrost available from Cyprus Industrial Minerals Co., Los Angeles, CA |
| Glass Fiber (chopped glass) | E-glass 405, silane coupled, about 0.32 cm in length, diameter about 14 microns, available from Owens Corning |

The composition of the first Example is shown in Table 1. 35 g talc and 2.5 g $TiO_2$ were dispersed in 100 g Epon826 using a high shear dissolver blade (available from Cowles Co.). 28.0 g talc, 2.0 g $TiO_2$ and 1.5 g DMP 30 were dispersed in 80 g Epicure 3270 using a high shear dissolver blade. The Epon826 based mixture and Epicure 3270 based mixture were separately mixed for 20–30 minutes at about 1400 rpm and at about 120°–130° F. (49°–54° C.). 126.5 g sand and 12.65 g chopped glass fiber were added to a container and shaken by hand to mix them; then they were preheated to 120°–130° F. (49°–54° C.). The premixed, preheated mixture of sand and chopped glass fibers were added with stirring at about 120°–130° F. to the side containing Epon826. This mixture was stirred with a low shear blade for about 3 minutes until the mixture appeared homogeneous. Care should be taken not to overstir this mixture as it may increase viscosity beyond the point where the compositions can be pumped or poured. In an analogous fashion, a premixed, preheated mixture of 150.02 g sand and 15.0 g chopped glass fibers was added to the side containing Epicure 3270. The total weight of the Epon826-based mixture was 276.6 g and the total weight of the Epicure-based mixture was 276.5 g. The resulting compositions from the separate sides were combined in a 1:1 volume ratio by pouring through a static mixer having helical mixing elements and then poured into a pavement marker shaped mold and cured for 10 minutes at 150° F. (66° C.).

During the initial mixing step, high shear is used to ensure complete dispersion of the small particles throughout the resin. When $TiO_2$ particles are used the degree of mixing can be judged by seeing that the mixture is completely white throughout. For samples that use predispersed titania particles (such as Epon 828/$TiO_2$) and do not contain other small particles such as $CaCO_3$ or talc, a high shear mixing step is unnecessary since the small particles are already highly dispersed. After the chopped glass fibers are added, care should be taken to avoid overmixing. The chopped fibers should be mixed in to achieve a mixture that resembles oatmeal. Overmixing of the mixture containing chopped fibers may make the mixture unpourable and unpumpable. Viscosity between 20,000–50,000 centiporse at about 130° F. (54° C.) is acceptable.

Examples 2–21 (see Table 1) were made by processes similar to that described for Example 1. Each of Examples 2–21 had a net weight of between about 130 g to about 1500 g. The weight percents listed in Examples 1–11 and 17–21 are weight percents of side A and side B which were mixed in the volume mix ratio shown at the bottom of each column (see Table 1). Examples 12–16 are listed in Table 1 in weight percent of the total composition. For Examples 2–21, side A and side B were mixed with a tongue depressor.

Examples 2–4 mixed chopped glass only in side A. Flexural moduli of Examples 2–4 ranged between $1.16–1.45\times10^7$ psi ($7.9–10.0\times10^{10}$ Pa). Nonetheless, Examples 2–4 exhibited an undesirable difference in viscosity between side A and side B.

Examples 5–7 exhibited similar viscosities between side A and side B. Flexural moduli testing of Examples 5–7 (sample size: 1 in.×0.125 in.×4.0 in (2.54 cm×0.32 cm×10.2 cm)) remained above $1\times10^7$ psi ($6.9\times10^{10}$ Pa).

Samples made of the composition of Example 11 demonstrated flexural moduli between about $0.74–1.12\times10^7$ psi ($5.1–7.7\times10^{10}$ Pa). Example 12 was made by dispensing $CaCO_3$ in Epon 826; mixing in Epon 828/$TiO_2$ until the material turned white throughout; mixing in Epicure 3720 with a tongue depressor; and then mixing in the glass fiber and sand to achieve the composite mixture. The sand and glass fibers were added at a temperature of about 110°–113° F. (43°–54° C.), and should be added within about 3 minutes of mixing in the Epicure (i.e. before the material sets). Examples 2–21 all showed acceptable strength when hit with a hammer. Little if any difference in strength was observed when switching from Epicure 3271 to Epicure 3270.

Modifications and variations of the above-described embodiments of the present invention are possible, as appreciated by those skilled in the art in light of the above teachings.

It is therefore to be understood that, within the scope of the appended claims and their equivalents, the invention may be practiced otherwise than as specifically described.

TABLE 1

Composition of Cast Markers

| Component In Weight Percent | Example No. 1 | 2 | 3 | 4 | 5 | 6 | 7 | 8 | 9 | 10 |
|---|---|---|---|---|---|---|---|---|---|---|
| Side A | | | | | | | | | | |
| Epon826 | 36.15 | 35.60 | 36.73 | 34.33 | 39.22 | 28.57 | 30.56 | 23.63 | 45.36 | 28.41 |
| Talc | 12.65 | 17.80 | 18.36 | 17.17 | | | | | | |
| $TiO_2$ | 0.90 | 2.27 | 2.34 | 3.58 | | | | | | |
| Epon828/$TiO_2$ Dispersed | | | | | 1.96 | 1.43 | 1.39 | 3.54 | 3.40 | 4.26 |
| ⅛" Chopped Fiber Glass | 4.57 | 8.01 | 6.75 | 4.49 | 5.88 | 7.00 | 6.81 | 7.86 | 8.37 | 7.10 |
| Silica Sand | 45.73 | 36.32 | 35.81 | 40.44 | 52.94 | 63.00 | 61.25 | 64.97 | 42.86 | 60.23 |
| Total | 100.00 | 100.00 | 100.00 | 100.00 | 100.00 | 100.00 | 100.00 | 100.00 | 100.00 | 100.00 |
| Side B | | | | | | | | | | |
| Epicure 3270 | 28.3 | | | | | | | | | |
| Epicure 3271 | | 28.57 | 26.62 | 26.82 | 30.77 | 30.00 | 29.48 | 26.18 | 19.42 | 21.74 |
| DMP30 | 0.54 | | | | | | | | | |
| Talc | 10.13 | 14.29 | 20.13 | 20.39 | | | | | | |
| $TiO_2$ | 0.72 | | | | | | | | | |
| $CaCO_3$ | | | | | | | | 17.02 | 12.62 | 13.04 |
| ⅛" Chopped Fiber | 5.42 | | | 5.28 | 6.92 | 7.00 | 7.05 | | | |
| Silica Sand | 54.25 | 57.14 | 53.25 | 47.51 | 62.31 | 63.00 | 63.47 | 56.81 | 67.96 | 65.22 |
| Total | 100.00 | 100.00 | 100.00 | 100.00 | 100.00 | 100.00 | 100.00 | 100.00 | 100.00 | 100.00 |
| Approximate Volumetric Mix Ratio of A/B: | 1.0 | 4.1 | 4.0 | 4.0 | 3.9 | 4.0 | 4.0 | 400 | 2.0 | 3.0 |

| Component In Weight Percent | Example No. 11 | 12 | 13 | 14 | 15 | 16 | 17 | 18 | 19 | 20 | 21 |
|---|---|---|---|---|---|---|---|---|---|---|---|
| Side A | | | | | | | | | | | |
| Epon826 | 15.27 | 15.57 | 13.92 | 15.57 | 15.28 | 15.28 | 33.88 | 33.88 | 34.41 | 34.60 | 37.09 |
| Talc | | | | | | | 11.86 | 11.86 | | | 12.98 |
| $TiO_2$ | | | | | | | 0.85 | 0.85 | | | 0.93 |
| Epon828/$TiO_2$ Dispersed | 1.80 | 1.50 | 4.69 | 1.50 | 1.50 | 1.50 | | | | | |
| $CaCO_2$ | | 10.00 | | | | 15.00 | | | 12.04 | 12.11 | |
| ⅛" Chopped Fiber Glass | | | | | 2.50 | 2.50 | 4.86 | 5.48 | 4.87 | 4.84 | 4.45 |
| Silica Sand | 82.93 | | 62.50 | 65.00 | 32.50 | 25.00 | 48.55 | 47.94 | 48.68 | 48.44 | 44.65 |
| Total | 100.00 | — | — | — | — | — | 100.00 | 100.00 | 100.00 | 100.00 | 100.00 |
| Side B | | | | | | | | | | | |
| Epicure 3270 | 68.18 | 12.93 | 12.64 | 12.93 | 13.22 | 13.22 | 30.51 | 29.67 | 30.12 | 31.68 | 30.39 |
| Epicure 3271 | | | | | | | | | | | |
| DMP30 | | | | | | | 0.57 | 0.56 | 0.56 | 0.59 | 0.57 |

TABLE 1-continued

| Composition of Cast Markers | | | | | | | | | | | |
|---|---|---|---|---|---|---|---|---|---|---|---|
| Talc | | | | | | | 10.68 | 10.39 | | | 10.64 |
| $TiO_2$ | | | | | | | 0.76 | 0.74 | | | 0.76 |
| $CaCO_3$ | | | | | 2.50 | | | | 10.54 | 11.09 | |
| ⅛" Chopped Fiber Glass | 31.82 | 5.00 | 6.25 | 5.00 | 32.50 | 2.50 | 5.23 | 6.01 | 5.34 | 5.15 | 4.46 |
| Silica Sand | | 55.00 | | | | 25.00 | 52.25 | 52.63 | 53.43 | 51.49 | 53.18 |
| Total | 100.00 | 100.00 | 100.00 | 100.00 | 100.00 | 100.00 | 100.00 | 100.00 | 100.00 | 100.00 | 100.00 |
| Approximate Mix Ratio of A/B: | 2.0 | 4.0 | — | — | 0.96 | 1.0 | 1.1 | 1.0 | 1.0 | 1.1 | 1.0 |

We claim:

1. A fiber-reinforced pavement marker comprising a freestanding composite material that is configured in the form of a pavement marker and that comprises an isotropic mixture of a polymeric material, reinforcing fibers and a filler material, the fiber reinforced pavement marker having an apparent flexural modulus of at least 80,000 psi.

2. The fiber-reinforced pavement marker of claim 1 having a retroreflective lens mounted thereon.

3. The fiber-reinforced pavement marker of claim 2, wherein said retroreflective lens is mounted in a polymeric holder and wherein said polymeric holder is secured to the surface of said composite material.

4. The fiber-reinforced pavement marker of claim 2 having an apparent flexural modulus greater than 400,000 psi.

5. The fiber-reinforced pavement marker of claim 1, wherein said polymeric material is a thermosetting resin selected from the group consisting of epoxy, acrylic and polyurethane.

6. The fiber-reinforced pavement marker of claim 5, wherein said filler material comprises silica-based sand particles and said reinforcing fibers are silica-based glass fibers.

7. The fiber-reinforced pavement marker of claim 6, wherein said glass fibers are comprised primarily of bundles of glass fibers randomly dispersed in said polymeric material.

8. The fiber-reinforced pavement marker of claim 1, wherein said filler material comprising inorganic oxide particles.

9. The fiber-reinforced pavement marker of claim 1, wherein said freestanding composite material is formed into a body comprising first and second opposed end faces, first and second opposed side faces, an upper face, and a generally planar bottom surface, said first and second end faces being inclined at an angle of approximately 30°, and said first and second side faces being convex from top-to-bottom and from end-to-end.

10. The fiber-reinforced pavement marker of claim 9, wherein said marker further comprises a retroreflective lens positioned on at least one of said first and second opposed end faces.

11. The fiber-reinforced pavement marker of claim 9, wherein said marker further comprises lens mounting system inset into at least one of said first and second opposed end faces and at least one retroreflective lens mounted in said lens mounting system.

12. The fiber-reinforced pavement marker of claim 11, wherein said lens mounting system is made from a molded plastic and comprises first and second lens mounts inset into said first and second end faces, respectively, at least one of said lens mounts having a plurality of energy directors extending upwardly therefrom for ultrasonic welding of said at least one lens thereto.

13. A pavement marker comprising a freestanding composite structure having first and second opposed end faces, first and second opposed side faces, an upper face, and a bottom surface; and having mounted on said freestanding composite structure a plastic crossmember extending from said first to said second opposed end faces, said plastic crossmember having a retroreflective lens disposed therein.

14. The pavement marker of claim 13 wherein said freestanding composite comprises an isotropic mixture of 30% to 76% polymeric material, 4% to 6% glass fibers, and 20% to 66% finer material, wherein percentages are weight percent of the total composite material.

15. A fiber-reinforced pavement marker comprising a composite material, said composite material comprising an isotropic mixture of 30% to 76% polymeric material, 4% to 6% glass fibers, and 20% to 66% filler material, wherein percentages are weight percent of the total composite material.

16. The fiber-reinforced pavement marker of claim 15, comprising 30 to 40 weight percent polymeric material, 20 to 30 weight percent fine filler particles having a particle diameter between about 0.01 and about 5 micron and 30 to 50 weight percent large filler particles having a diameter about 300 to about 850 microns.

17. The fiber-reinforced pavement marker of claim 16, wherein said small particles comprise talc and said large particles comprise sand.

18. A method of making a fiber-reinforced pavement marker comprising the steps:

casting a homogeneous mixture comprising polymeric material reinforcing fibers and filler material in a mold to form a cast composite material hardened in the shape of a raised pavement marker; and then removing the resulting cast, raised pavement marker from the mold.

19. The method of claim 18 wherein a retroreflective lens is placed in said mold prior to depositing said homogeneous mixture.

20. The method of claim 19, wherein said setting step is conducted at reduced pressure.

21. The method of claim 19, wherein the retroreflective lens has one surface facing the surface of the composite material and an opposing surface facing away from said composite material, and further wherein, during casting, said opposing surface is covered by a strippable pressure sensitive adhesive film.

22. The method of claim 18, wherein said mold is vibrated to completely distribute said mixture in said mold.

23. The method of claim 18, comprising the additional step of bonding a retroreflective lens to said cast, raised road marker.

24. The method of claim 18, wherein said polymeric material is a thermosetting resin.

25. The method of claim 18, wherein said step of setting is conducted at about 80° C. for about 10 minutes.

26. The method of claim 18, wherein said resin is a mixture of epoxy resin and curing agent.

27. The method of claim 18, wherein said epoxy resin and said curing agent are mixed in a static mixer with helical mixing elements to form a mixed resin; and further wherein said mixed resin is deposited into said mold.

28. The method of claim 18, wherein said fiber-reinforced pavement marker further comprises a modified base wherein said base is modified by a modification selected from the group consisting of: forming indentations on said base; bonding a polymer impregnated glass mat to said base; dropping chopped glass fibers onto said base at an elevated temperature and dropping sand onto said base at an elevated temperature.

* * * * *

UNITED STATES PATENT AND TRADEMARK OFFICE

CERTIFICATE OF CORRECTION

PATENT NO.: 5,667,335

DATED: September 16, 1997

INVENTOR(S): Sithya S. Khieu and David C. May

It is certified that error appears in the above-identified patent and that said Letters Patent is hereby corrected as shown below:

At column 16, line 48, "material reinforcing" should read – material, reinforcing --.

Signed and Sealed this

Sixteenth Day of June, 1998

*Attest:*

*Attesting Officer*

BRUCE LEHMAN

*Commissioner of Patents and Trademarks*